US008287098B2

(12) United States Patent
Mukai et al.

(10) Patent No.: US 8,287,098 B2
(45) Date of Patent: Oct. 16, 2012

(54) LIQUID EJECTION HEAD, LIQUID SUPPLY APPARATUS, LIQUID EJECTION APPARATUS, AND LIQUID SUPPLY METHOD

(75) Inventors: Kayo Mukai, Mitaka (JP); Tomohiro Fujii, Matsudo (JP); Hiroyuki Ishinaga, Tokyo (JP); Yoichi Sonobe, Matsudo (JP)

(73) Assignee: Canon Finetech Inc., Ibaraki (JP)

( * ) Notice: Subject to any disclaimer, the term of this patent is extended or adjusted under 35 U.S.C. 154(b) by 330 days.

(21) Appl. No.: 12/645,898

(22) Filed: Dec. 23, 2009

(65) Prior Publication Data

US 2010/0097433 A1 Apr. 22, 2010

Related U.S. Application Data

(62) Division of application No. 11/560,538, filed on Nov. 16, 2006, now Pat. No. 7,661,798.

(30) Foreign Application Priority Data

Nov. 25, 2005 (JP) ..... 2005-340672
Nov. 25, 2005 (JP) ..... 2005-340673
Sep. 25, 2006 (JP) ..... 2006-259176

(51) Int. Cl.
*B41J 2/05* (2006.01)

(52) U.S. Cl. ..... 347/56

(58) Field of Classification Search ..... 347/56, 347/54, 55, 57, 61, 62, 93, 65, 66, 67
See application file for complete search history.

(56) References Cited

U.S. PATENT DOCUMENTS

| | | | | |
|---|---|---|---|---|
| 4,737,801 | A | 4/1988 | Ichihashi et al. | |
| 5,457,485 | A | 10/1995 | Moriyama et al. | |
| 5,489,930 | A | 2/1996 | Anderson | 347/71 |
| 5,546,109 | A | 8/1996 | Nakano | |
| 6,000,792 | A | 12/1999 | Koizumi et al. | |
| 6,234,623 | B1 | 5/2001 | Drake | 347/93 |
| 6,540,343 | B1 | 4/2003 | Umeyama et al. | 347/93 |
| 6,715,863 | B2 | 4/2004 | Shimizu | |
| 6,951,383 | B2 | 10/2005 | Giere et al. | 347/56 |
| 7,399,075 | B2 | 7/2008 | Nomura et al. | |
| 7,661,798 | B2 * | 2/2010 | Mukai et al. | 347/56 |
| 2002/0027583 | A1 | 3/2002 | Nakamura | |
| 2002/0113836 | A1 | 8/2002 | Sonobe | |
| 2004/0125179 | A1 | 7/2004 | Watanabe | |
| 2005/0243145 | A1 | 11/2005 | Essen | |
| 2005/0253910 | A1 | 11/2005 | Gao et al. | |
| 2006/0164477 | A1 | 7/2006 | Fujii et al. | |

(Continued)

FOREIGN PATENT DOCUMENTS

EP 0 448 967 10/1991

(Continued)

*Primary Examiner* — Kristal Feggins
(74) *Attorney, Agent, or Firm* — Fitzpatrick, Cella, Harper & Scinto

(57) ABSTRACT

A liquid ejection head, a liquid supply apparatus, a liquid ejection apparatus, and a liquid supply method can enable the channel resistance and pressure loss of liquid in the liquid ejection head to be reduced to increase the speed at which liquid is supplied to the nozzles. To achieve this, an ink supply chamber is placed so as to be laminated on a main ink supply chamber. A filter interposed between the main ink supply chamber and the ink supply chamber extends along a surface substantially parallel to a nozzle arrangement plane on which a plurality of nozzles are arranged.

7 Claims, 13 Drawing Sheets

U.S. PATENT DOCUMENTS

2008/0259145 A1 10/2008 Nomura et al.

FOREIGN PATENT DOCUMENTS

| | | | |
|---|---|---|---|
| EP | 1 533 126 | | 5/2005 |
| EP | 1 683 640 | | 7/2006 |
| JP | 02-000520 | | 1/1990 |
| JP | 06-064183 | | 3/1994 |
| JP | 06-183024 | A | 7/1994 |
| JP | 08-118672 | | 5/1996 |
| JP | 09-011496 | A | 1/1997 |
| JP | 2000-103074 | A | 4/2000 |
| JP | 2000-103075 | A | 4/2000 |
| JP | 2002-144576 | A | 5/2002 |
| JP | 2004-82544 | A | 3/2004 |
| JP | 2005-053048 | A | 3/2005 |
| JP | 2005-306005 | A | 11/2005 |
| JP | 2003-001847 | A | 1/2008 |
| WO | WO 01/39978 | | 6/2001 |
| WO | WO2004/02881 | | 4/2004 |

* cited by examiner

LIQUID EJECTION HEAD, LIQUID SUPPLY APPARATUS, LIQUID EJECTION APPARATUS, AND LIQUID SUPPLY METHOD

This is a division of U.S. patent application Ser. No. 11/560,538, filed Nov. 16, 2006.

This application claims the benefit of Japanese Patent Application Nos. 2005-340672, filed Nov. 25, 2005, 2005-340673, filed Nov. 25, 2005 and 2006-259176, filed Sep. 25, 2006, which are hereby incorporated by reference herein in their entirety.

BACKGROUND OF THE INVENTION

1. Field of the Invention

The present invention relates to a liquid ejection head that is able to eject a liquid through nozzles, a liquid ejection apparatus that allows the liquid to be ejected from the liquid ejection head, and a liquid supply apparatus and method for supplying the liquid to the liquid ejection head.

The liquid ejected from the liquid ejection head may be selected from various liquids such as ink and medical agents. If ink is used as the liquid, images can be printed by applying ink to a print medium.

2. Description of the Related Art

As liquid supply systems for liquid ejection heads, ink supply systems supplying ink to an ink jet print head (liquid ejection head) have been improved so as to adjust to increased printing speeds. However, these ink supply systems require a filter to be disposed in a channel to trap foreign matter or bubbles present in ink (liquid). Consequently, the flow of ink is subjected to a significant pressure loss in the filter portion. This prevents high-speed printing.

If the filter area is increased to reduce the pressure loss in order to solve the above problem, bubbles in a liquid chamber may remain on a bottom surface of the filter to hinder the supply of the liquid.

A proposal has thus been made that a valve be provided to close a part of the filter so as to increase the flow speed of ink only during a process of recovering a print head, to purge the bubbles (Japanese Patent Laid-Open No. 06-064183). As a similar example, a proposal has been made that a valve be provided in tight contact with the filter so as to make it easy to also increase the flow speed of ink during the process of recovering the print head to purge the bubbles (Japanese Patent Laid-Open No. 08-118672).

However, with the methods described in Japanese Patent Laid-Open Nos. 06-064183 and 08-118672, the valve provided in the vicinity of the filter complicates the structure of the system.

Further, with these conventional methods, the filter increases channel resistance during a printing operation. This makes it difficult to maintain the interior of the print head at a predetermined negative pressure. In particular, in a printing apparatus that performs a high-speed printing operation using an elongate print head (wide line head) extending across the width of a print medium, a variation in pressure increases in the vicinity of the nozzles in the print head. This makes it difficult to maintain a proper printing operation.

SUMMARY OF THE INVENTION

An object of the present invention is to provide a liquid ejection head, a liquid supply apparatus, a liquid ejection apparatus, and a liquid supply method which enable the channel resistance and pressure loss of a liquid in the liquid ejection head to be reduced to increase the speed at which the liquid is supplied to the nozzles.

Another object of the present invention is to provide a liquid ejection head, a liquid supply apparatus, a liquid ejection apparatus, and a liquid supply method which enable bubbles in a liquid chamber in the liquid ejection head to be moved to increase bubble removal efficiency or to maintain liquid supply performance.

Yet another object of the present invention is to provide a liquid ejection head, a liquid supply apparatus, a liquid ejection apparatus, and a liquid supply method which enable bubbles to be efficiently discharged from a liquid ejection head comprising a large-area filter.

In a first aspect of the present invention, there is provided a liquid ejection head having a plurality of nozzles communicated with a common liquid chamber, the nozzles being arranged on the same nozzle arrangement plane, liquid in the common liquid chamber being ejected from the nozzles, the head comprising: a main liquid supply chamber communicated with the common liquid chamber; a liquid supply chamber adjacent to the main liquid supply chamber; a filter interposed between the main liquid supply chamber and the liquid supply chamber and extending along a surface parallel to the nozzle arrangement plane; and an opening communicated with the liquid supply chamber.

In a second aspect of the present invention, there is provided a liquid supply apparatus for supplying liquid to the liquid ejection head according to the first aspect of the present invention, the apparatus comprising: a communication path allowing the opening and a liquid tank capable of accommodating liquid to communicate with each other.

In a third aspect of the present invention, there is provided a liquid ejection apparatus for ejecting liquid from the liquid ejection head according to the first aspect of the present invention, the apparatus comprising: a communication path allowing the opening and a liquid tank capable of accommodating liquid to communicate with each other.

According to the present invention, the liquid supply chamber and main liquid supply chamber in the liquid ejection head are arranged adjacent to each other. Further, the filter interposed between the liquid supply chamber and main liquid supply chamber extends along the surface substantially parallel to the nozzle arrangement plane on which the plurality of nozzles are arranged. This enables the channel resistance and pressure loss of the liquid in the liquid ejection head to be reduced to increase the speed at which the liquid is supplied to the nozzles.

Furthermore, the inclined surface portion is formed on the top wall portion of main liquid supply section. This enables the bubbles in the main ink supply chamber to be positively moved to increase the bubble removal efficiency or to maintain the liquid supply performance.

If ink is ejected from the liquid ejection head to print an image, the present invention allows ink to be smoothly supplied to achieve high-speed printing. Moreover, the bubbles can be efficiently removed without producing a large amount of waste ink.

The liquid ejection head may comprise, as the liquid supply chamber, the first and second liquid supply chambers, and as the filter, the first filter interposed between the liquid supply chamber and the first liquid supply chamber and the second filter interposed between the liquid supply chamber and the second liquid supply chamber. Then, the liquid ejection head can be supplied with the liquid through the first liquid supply chamber and first filter and can discharge the liquid through the second filter and second liquid supply chamber. This enables the bubbles in the liquid ejection head comprising the large-area filter to be efficiently discharged together with the flow of the liquid.

DESCRIPTION OF THE EMBODIMENTS

Embodiments of the present invention will be described below with reference to the drawings.

First Embodiment

FIGS. 1 to 10 are diagrams illustrating a first embodiment of the present invention.

Figure 1:
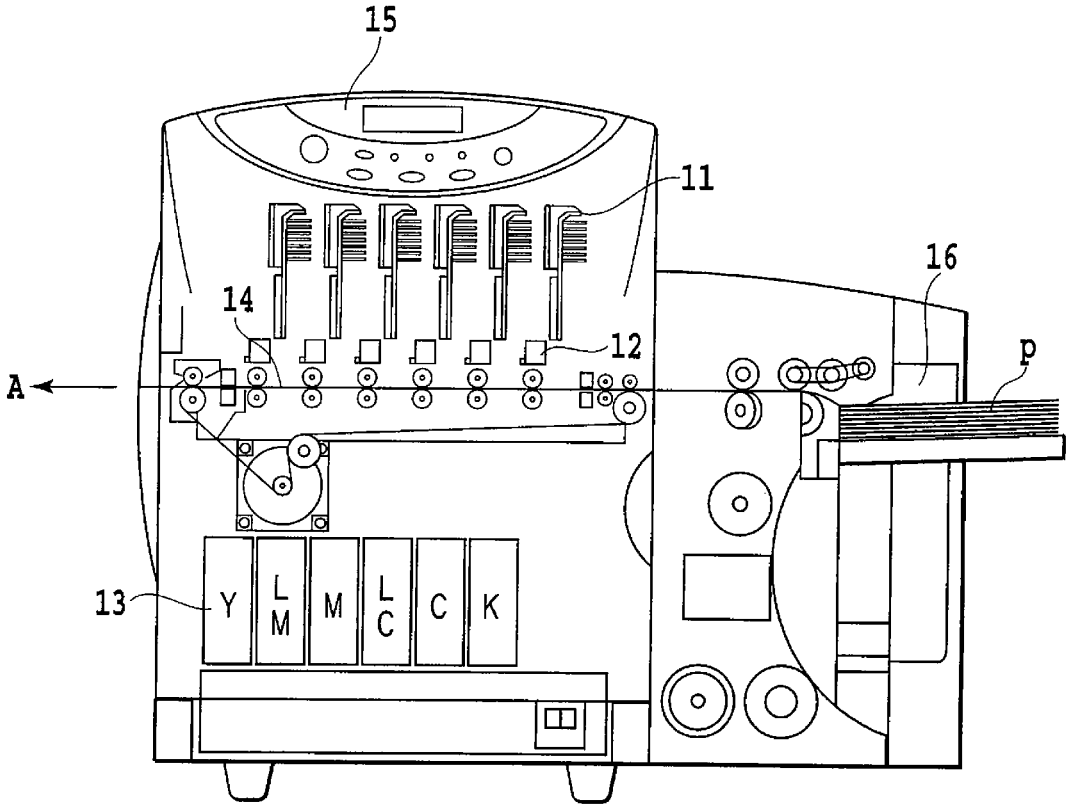
FIG. 1 is a schematic diagram showing the configuration of a liquid ejection apparatus in which a liquid ejection head is mounted according to a first embodiment of the present invention.

FIG. 1 is a schematic front view illustrating an example of a configuration of an ink ejection apparatus (liquid ejection apparatus) according to the present invention. The ink ejection apparatus in the present example constitutes a printing apparatus that prints an image on a print sheet (print medium) using six liquid ejection heads 11. The ink ejection apparatus in the present example is composed of recovery units 12 corresponding to the respective heads 11, ink cartridges 13 that accommodate ink (liquid) to be supplied to the respective head 11, a conveying portion 14, an operation panel portion 15, a sheet feeding portion 16, and the like. A print sheet P is fed from the sheet feeding portion 16 to the conveying portion 14, which conveys the print sheet P in the direction of arrow A. When the print sheet P moves through print positions located opposite the respective heads 11, ink is ejected from the heads 11 onto the print sheet P to print an image. The heads 11 are arranged along the direction in which the print sheet P is transported (direction of arrow A). A plurality of ejection ports are formed in each head 11 and arranged in a direction crossing the transporting direction of the print sheet P (in the present example, the direction orthogonal to the transporting direction). The ejection ports form nozzles together with an ink channel and ejection energy generating means as described below. The heads 11 are supplied with yellow ink (Y), light magenta ink (LM), magenta ink (M), light cyan ink (LC), cyan ink (C), and black ink (K), respectively, from the corresponding ink cartridges 13. Each of the heads 11 ejects the corresponding ink through the ejection ports in response to a driving signal.

The ink ejection apparatus in the present example is an ink jet printing apparatus to which the present invention is applied. The ink jet printing apparatus uses an elongate head 11 extending all over the width of a printing area in the print sheet P. However, the present invention is also applicable to a serial scan ink jet printing apparatus that repeats printing scan in a main scanning direction of the head and transporting the print sheet by a predetermined amount in a sub-scanning direction crossing the main scanning direction.

Figure 2:
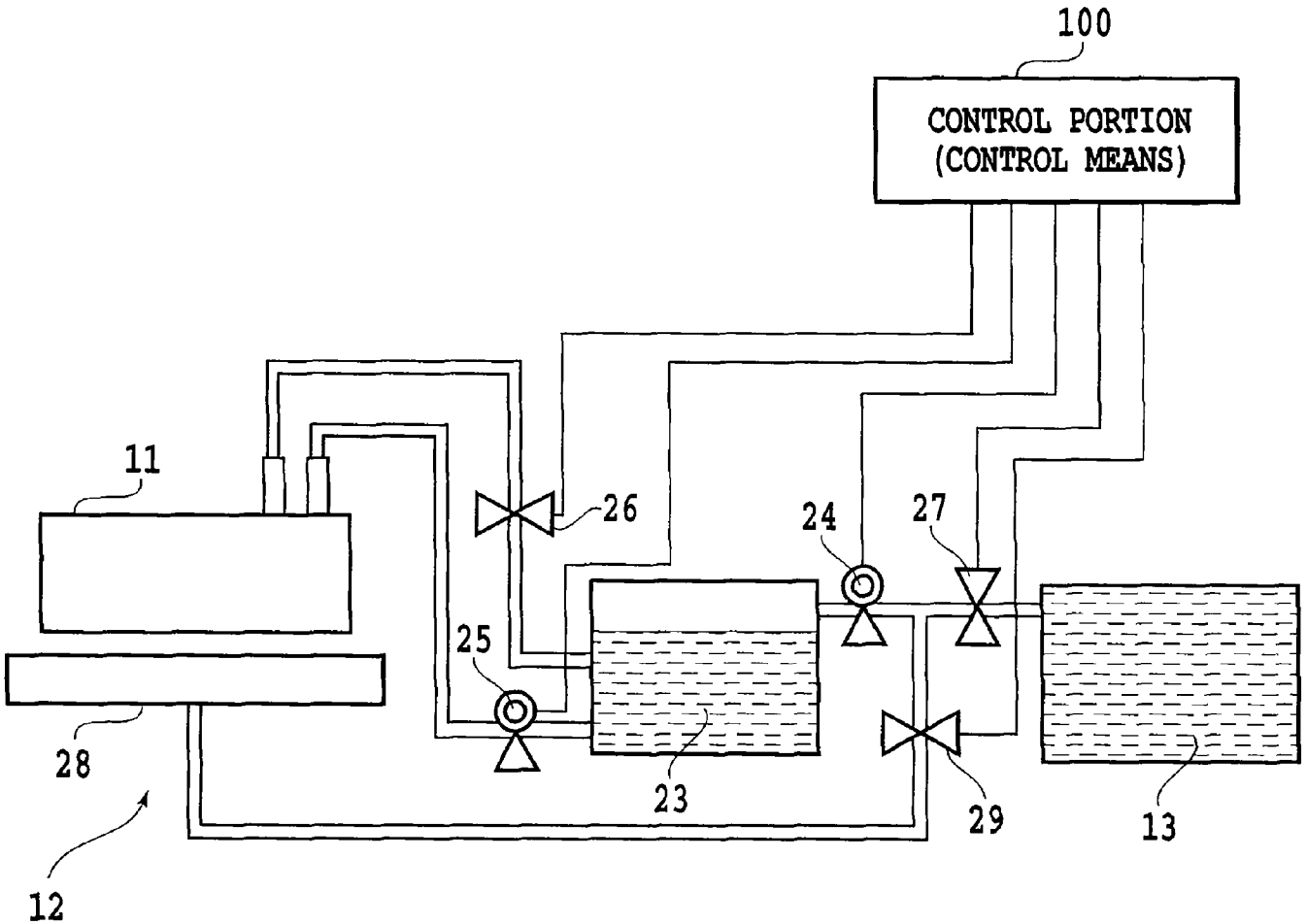
FIG. 2 is a schematic diagram showing the configuration of a system for supplying a liquid to the liquid ejection head in FIG. 1.

FIG. 2 is a schematic diagram showing the configuration of an ink supply system (liquid supply system) in the ink ejection apparatus in FIG. 1. The ink in the removably installed ink cartridge 13 is supplied to the head 11 through a sub-tank 23 so as to form an appropriate orifice surface of ink in each ejection port in the head 11. Reference numeral 24 denotes a supply pump that supplies ink from the ink cartridge 13 to the sub-tank 23. Reference numeral 25 denotes a pressurization pump that supplies ink from the sub-tank 23 to the head 11. Reference numeral 26 denotes a recovery valve that closes an ink return path before pressurization of the head 11 described below. The supply pump 24 is also used for a recycle operation described below. Reference numeral 27 denotes a supply valve used to select an ink path for the recycle operation. The recycle operation allows ink discharged to recover the head 11 to be recycled. A recovery tub 28 in the recovery unit 12 is used for the recycle operation. The recycle tub 28 is installed below an ejection surface (ejection port formation surface) of the head 11. The ink path from the recovery tub 28 to the sub-tank 23 is opened and closed by a recycle valve 29.

The supply pump 24, pressurization pump 25, recovery valve 26, supply valve 27, and recycle valve 29 are controlled in association with one another by a control portion (control means) 100 depending on an operation mode described below.

Now, description will be given of operation modes of the ink supply system in the ink ejection apparatus.

The ink supply system has four operation modes, a print mode, an ink supply mode, a circulation mode, and a pressurization mode. In the print mode, ink from the sub-tank 23 is supplied to the head 11 to print an image. In the ink supply mode, ink from the ink cartridge 13 is supplied to the sub-tank 23. In the circulation mode, ink is circulated between the sub-tank 23 and the head 11. In the pressurization mode, ink from the sub-tank 23 is supplied to the head 11 under pressure.

In the print mode, ink is ejected from the head 11 to reduce ink in the head 11 and thus the internal pressure of the head 11. Then, a capillary phenomenon in the nozzles in the head 11 allows ink in the sub-tank 23 to be supplied to the head 11 through the pressurization pump 25 and recovery valve 26. In the ink supply mode, the supply pump 24 is actuated to supply ink from the cartridge 13 to the interior of the sub-tank 23. In the circulation mode, the pressurization pump 25 allows ink to be circulated between the sub-tank 23 and the head 11. Specifically, ink in the sub-tank 23 is fed to the interior of the head 11 by the pressurization pump 25. Ink in the head 11 is then returned to the interior of the sub-tank 23 through the recovery valve 26. This circulation of ink removes bubbles from the heads 11 and channel to allow appropriate printing as described below. Ink discharged to the recovery tub 28 from the ejection ports of the head 11 in the circulation mode is returned to the sub-tank 23 through the recycle valve 29 by the operation of the supply pump 24. The pressurization mode is executed to discharge bubbles, ink with an increased viscosity, foreign matter, and the like from the nozzles of the head 11 as described below. In the pressurization mode, the recovery valve 26 is closed and the pressurization pump 25 is driven to forcibly feed the ink from the sub-tank 23 to the head 11. The ink is thus forcibly discharged to the interior of the recovery tub 28 from the ejection ports of the head 11.

Figure 3:
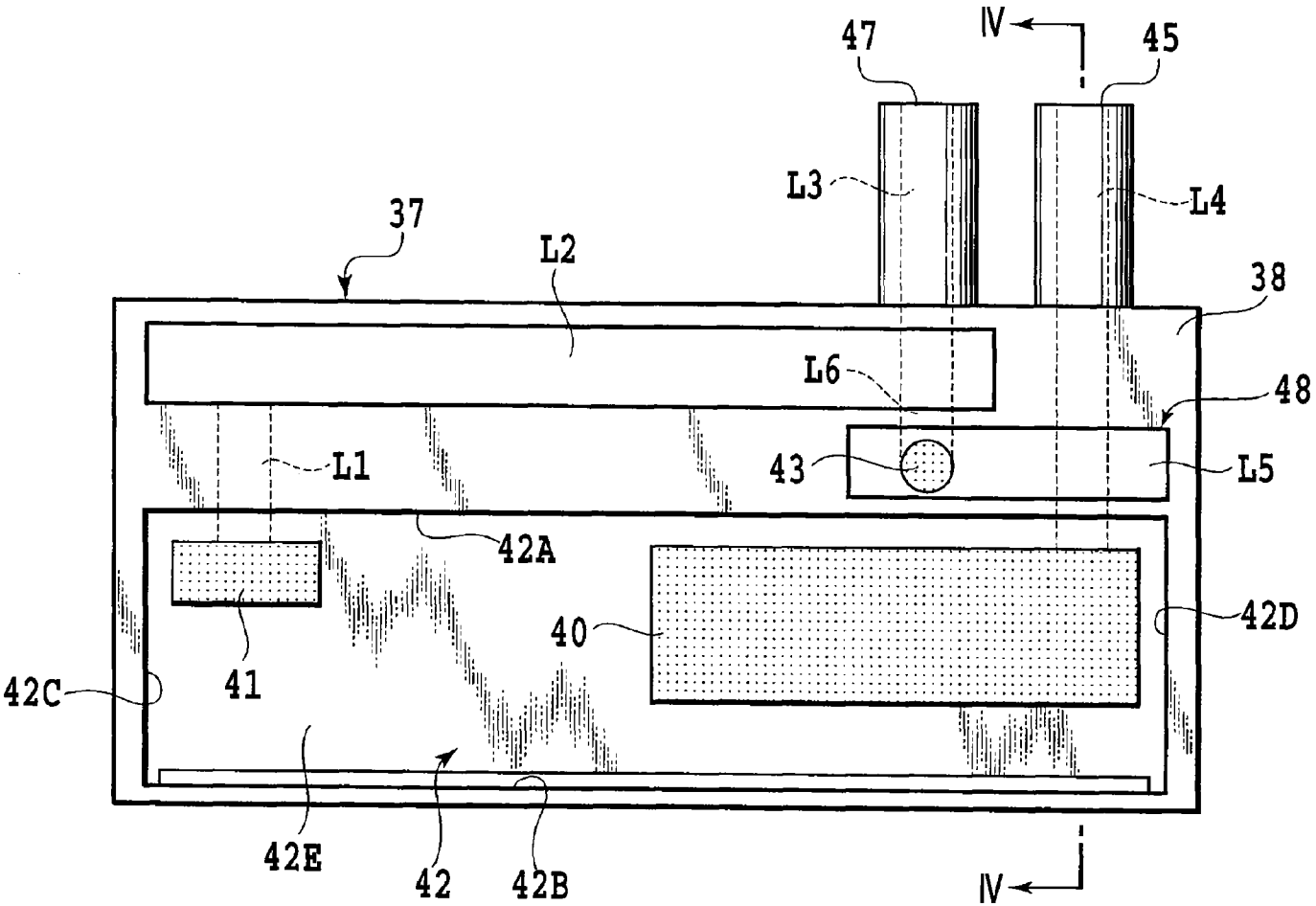
FIG. 3 is an enlarged front view of an essential part of the liquid ejection head in FIG. 1.
Figure 4:
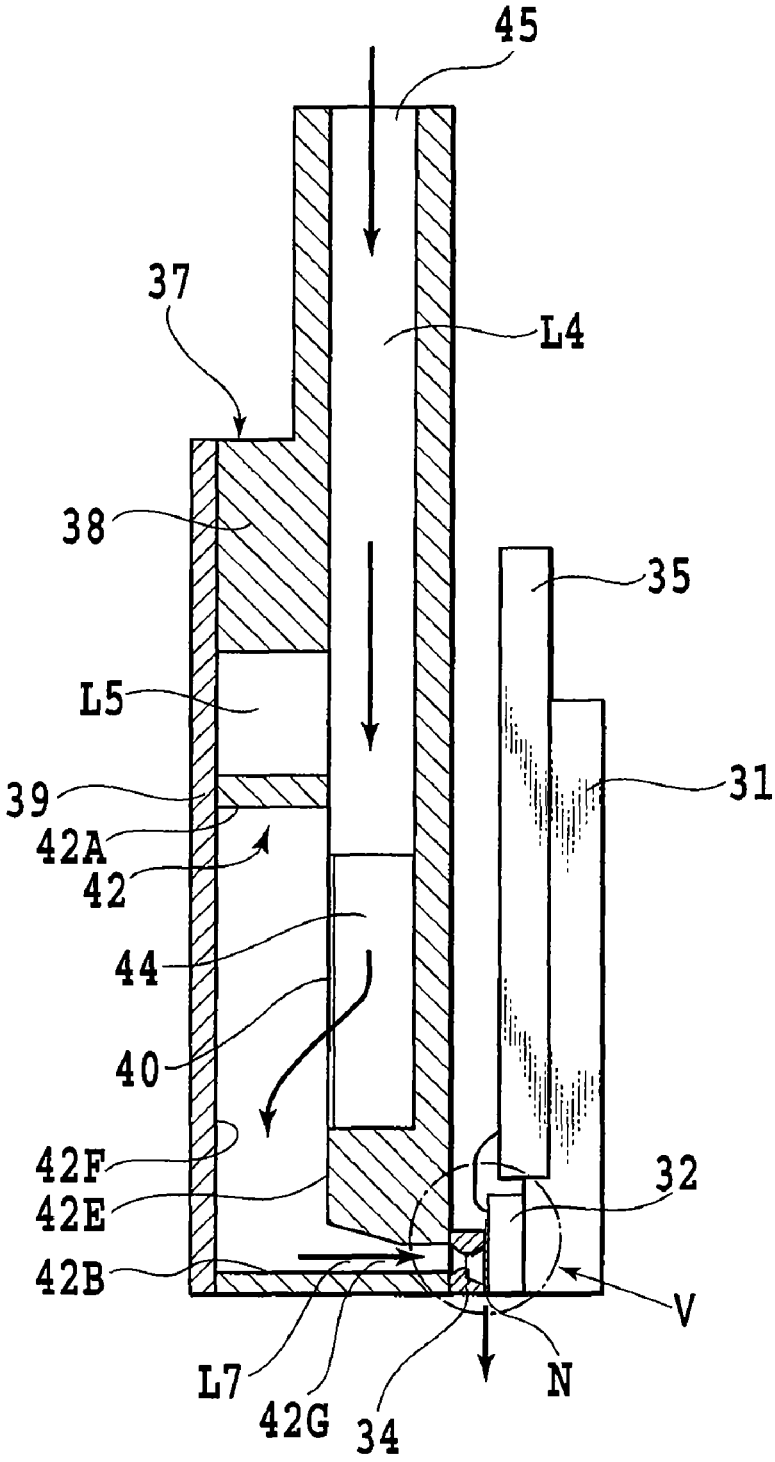
FIG. 4 is a sectional view taken along line IV-IV in FIG. 3.
Figure 5:
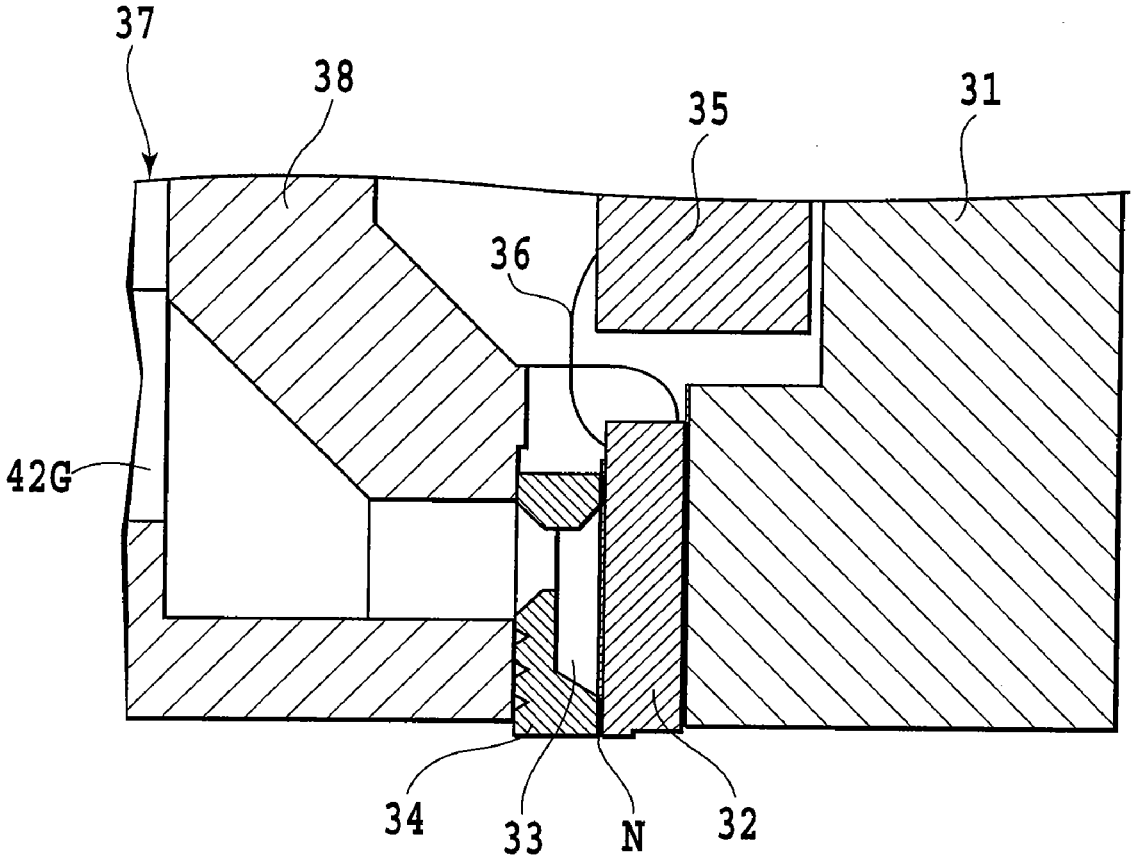
FIG. 5 is an enlarged view of a circular part V in FIG. 4

FIG. 3 is a front view illustrating an example of configuration of the head 11. FIG. 4 is a sectional view taken along line IV-IV in FIG. 3. FIG. 5 is an enlarged view of a circular part V in FIG. 3. The head in the present example has a print width (corresponding to the length of a nozzle array) of four inches.

In these figures, a ceramic base plate 31 supports a heater substrate 32 formed of silicon. A plurality of electrothermal converters (heaters) and a plurality of channel walls are formed on the heater substrate 32; the electrothermal converters serve as ink ejection energy generating elements and the channel walls form ink channels corresponding to the electrothermal converters. The electrothermal converters and ink channels constitute a plurality of nozzles N through which the ink can be ejected from the ejection ports. A liquid chamber frame is also formed on the heater substrate 32 to enclose a common liquid chamber 33 that is in communication with the nozzles N. A roof plate 34 is jointed to the side walls of the nozzles N and the liquid chamber frame in order to form the common liquid chamber 33. Consequently, the heater substrate 32 and roof plate 34 are integrally laminated on and bonded to a base plate 31. The laminate bonding is carried out using a thermally conductive adhesive such as silver paste. A pre-mounted PCB (wiring circuit board) 35 is supported on the base plate 31 behind the heater substrate 32 (upper part of FIG. 4) with an adhesive double coated tape. The ejection energy generating elements on the heater substrate 32 and PCB 35 are electrically connected together via wire bondings 36 corresponding to the respective wires.

An ink supply member (liquid supply member) 37 is joined to a top surface of the roof plate 34. The ink supply member 37 is composed of an ink supply case (liquid supply case) 38 and an ink supply case cover (liquid supply case cover) 39. A liquid chamber and a channel groove are pre-formed in the ink supply case 38; the channel groove is in communication with the liquid chamber. The ink supply case cover 39 closes a top surface of the ink supply case 38 to form a tubular channel as described below. In the present example, the ink supply case 38 and ink supply case cover 39 are joined together with a thermosetting adhesive. Ink is supplied to a communication path 34A formed in the roof plate 34, through the channel formed in the ink supply member 37.

Three filters, a first filter 40, a second filter 41, and a third filter 43, are disposed in the ink supply case 38. The first filter 40 is intended to remove foreign matter from ink. The second filter 41 is intended to remove bubbles from a main ink supply chamber (main liquid supply chamber) 42. The third filter 43 is intended to remove bubbles from a first ink supply chamber (first liquid supply chamber) 44. The filters 40, 41, and 43 are formed of a material of stainless fibers woven into a mesh at the intervals of 8 μm. The filters 40, 41, and 43 are fixed to the liquid supply case 38 by thermal welding. The functions of the filters 40, 41, and 43 will be described below in detail.

Figure 6:
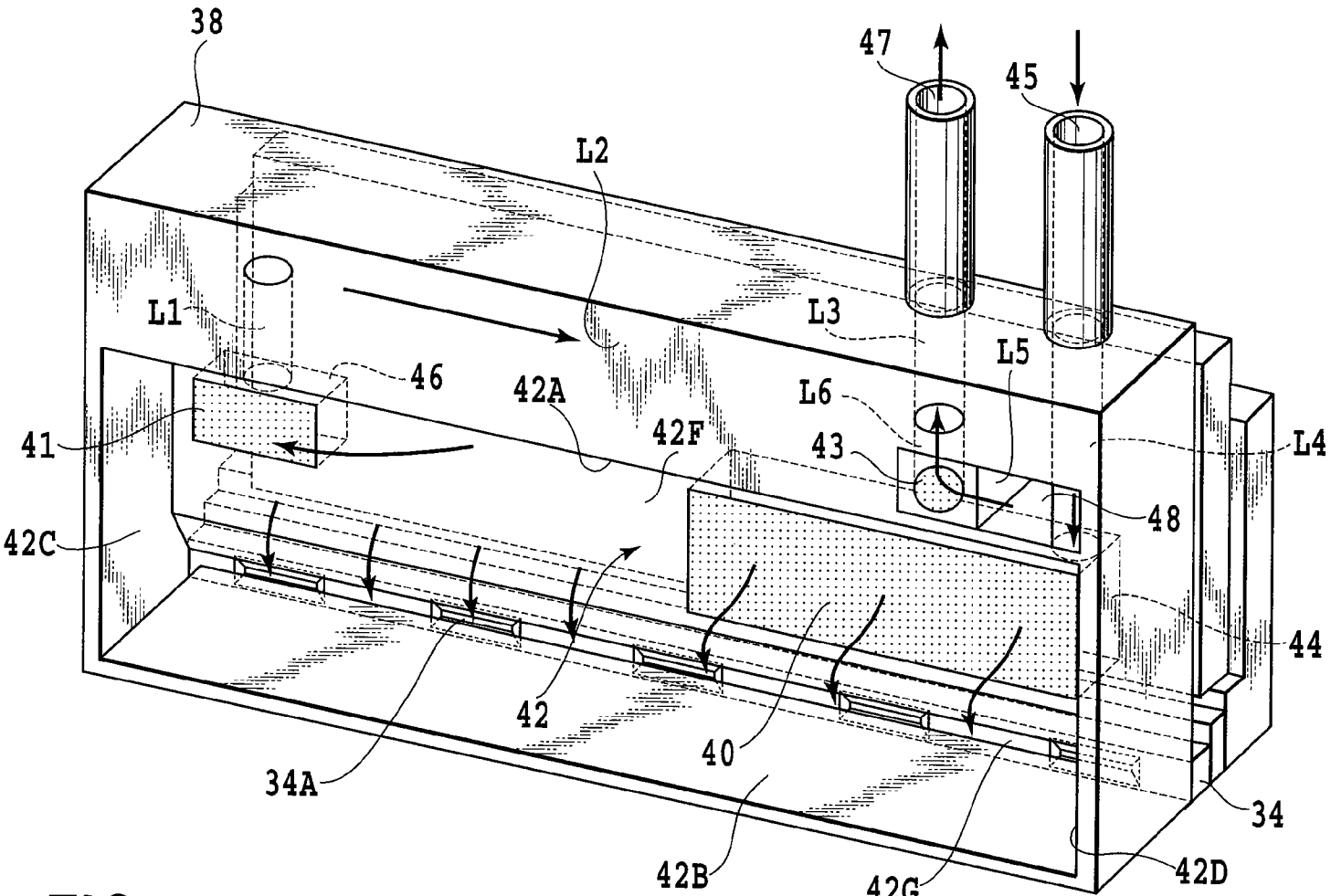
FIG. 6 is a perspective view of an essential part of the liquid ejection head in FIG. 1.

FIG. 6 is a perspective view of essential part of the head 11 in the present example. This figure is a perspective view of the head 11 as viewed from the ink supply case 38. For the convenience of description, the ink supply case cover 39, screws, and the like are omitted in the figure.

The ink in the sub-tank 23 of the ink ejection apparatus is supplied to the first ink supply chamber 44 through a first joint opening 45 in the head 11. The ink in the first ink supply chamber 44 is supplied to the main ink supply chamber 42 through the first filter 40. The main ink supply chamber 42 is formed of a top wall portion 42A and a bottom wall portion 42B and four wall portions, a left wall portion 42C, a right wall portion 42D, a front wall portion 42E, and a rear wall portion 42F. Of the wall portions 42A to 42F, the wall portion 42F is formed on the ink supply case cover 39, while the others are formed on the ink supply case 38. The first ink supply chamber 44 is installed so as to be laminated on the main ink supply chamber 42. The first ink supply chamber 44 is also located adjacent to the main ink supply chamber 42.

The ink supplied to the main ink supply chamber 42 reaches the nozzles N via a supply port 42G formed in the wall portion 42E and a communication path 34A and common liquid chamber 33 formed in the roof plate 34 (see FIG. 5). The ink supplied to the main ink supply chamber 42 is fed to a second ink supply chamber (second liquid supply chamber) 46 through the second filter 41 and returns to the sub-tank 23 via a second joint opening 47. The second ink supply chamber 46 is installed so as to be laminated on the main ink supply chamber 42. The second ink chamber 46 is also located adjacent to the main ink supply chamber 42.

With this ink flow, the ink must be smoothly supplied to the nozzles N in order to achieve high-speed printing. That is, the apparatus needs to be designed to minimize the channel resistance in the ink channel. Thus, in the head 11 of the present example, the first ink supply chamber 44, main ink supply chamber 42, common liquid chamber 33, and nozzles N are in direct communication with one another as shown in FIGS. 3 to 5. Further, the first joint opening 45, first ink supply chamber 44, and nozzles N form a linear channel extending from the top to bottom of FIG. 4. To reduce the channel resistance in the head 11, a sectional area of the channel has a diameter equal to or larger than the inner diameter of the first joint opening 45 which is an inlet of the head 11. This allows the ink to be smoothly supplied. In the present example, the channel generally has a sectional area of at least ϕ3 (diameter: 3 mm).

Moreover, to prevent the ink supply performance from being degraded, the filter, which may cause a pressure loss to the ink in the head 11, has an increased area. In the present example, the first filter 40 has an effective area of ϕ20 (diameter: 20 mm) so as to minimize a possible pressure loss. The first filter 40 is also placed on a plane parallel to a nozzle arrangement plane on which the array of nozzles N is positioned, to avoid an increase in the size of the head 11 resulting from the increased area of the filter 40. To exert such an effect, the filter 40 need not be perfectly parallel to the nozzle arrangement plane but has only to be substantially parallel to it. Therefore, the placement of the filter 40 on a plane parallel to the nozzle arrangement plane includes the placement of the filter on a plane substantially parallel to the nozzle arrangement plane.

The nozzles N are formed between the heater substrate 32 and the roof plate 34. Accordingly, the nozzle arrangement plane extends in the vertical direction of FIGS. 4 and 5 along the junction between the heater substrate 32 and the roof plate 34. The first filter 40 is positioned on the plane parallel to the nozzle arrangement plane, that is, the plane parallel to the sheet of FIG. 3.

On the other hand, the greatest problem with the adoption of the large-area first filter 40 is removal of bubbles that are likely to be retained upstream of the filter. In the present example, the problem is removal of bubbles that are likely to be retained in the first ink supply chamber 44. The bubbles remaining in this part hinder the supply of the ink to prevent the entire effective area of the filter 40 from being effectively utilized.

Thus, in the present example, a bypass channel 48 is formed to allow the first ink supply chamber 44 and second ink supply chamber 46 to communicate with each other. A third filter 43 is further provided in the bypass channel 48 to solve the above problem. The third filter 43 is designed to have a small area so as to remove bubbles flowing in together with the ink, from the first ink supply chamber 44. That is, the reduced area of the third filter 43 increases the flow speed of the ink flowing from the first ink supply chamber 44 through the third filter 43, removing the bubbles from the first ink supply chamber 44.

However, the excessively reduced area of the third filter 43 increases the resistance of the ink flowing through the third filter 43. This may completely prevent the flow of the ink to the third filter 43. In this case, the bubbles cannot be removed from the first ink supply chamber 44. On the other hand, the excessively increased area of the third filter 43 reduces the flow resistance in the third filter 43 below that in the first filter 40. Then, most of the ink in the first ink supply chamber 44 may flow to the third filter 43 but not to the first filter 40, to which the ink is originally to be supplied. In the present example, the third filter 43 has an area of $\phi 2$ (diameter: 2 mm) so as to enable the ink to be efficiently supplied to the main ink supply chamber 42 through the first filter 40 while removing the bubbles from the first ink supply chamber 44. Changing the density of the third filter 43 enables an increase in the flow speed of the ink passing through the third filter 43.

The ink ejection apparatus in the present example requires heat generation energy to eject the ink. That is, the ink ejection apparatus is configured so that the ink is bubbled by thermal energy generated by the electrothermal converter on the heater substrate 32 and so that the resulting bubbling energy is used to eject the ink downward in FIG. 5. Thus, a long continuous printing operation may accumulate the thermal energy in the ink to raise its temperature. A gas dissolved in the ink may then be collected in the head 11. The ink is inappropriately ejected unless the bubbles in the head 11 are removed. The ejection energy generating means for ejecting the ink is not limited to the configuration using the electrothermal converter but may have any configuration, for example, one that uses a piezo element or the like to eject the ink.

In the head 11 in the present example, as shown in FIG. 4, the nozzles N, common liquid chamber 33, and main ink supply chamber 42 are in direct communication with one another to enable bubbles resulting from a printing operation to be stored in the main ink supply chamber 42. Further, the main ink supply chamber 42 has a large capacity to make it possible to store a large amount of bubbles to some degree. Furthermore, the second filter 41 enables the bubbles present in the main ink supply chamber 42 to be easily removed. Specifically, in the circulation mode, in which the pressurization pump 25 circulates the ink between the sub-tank 23 and the head 11, the flow speed of the ink passing through the second filter 41 can be increased to allow the bubbles in the main ink supply chamber 42 to be easily removed through the second filter 41.

FIGS. 7 to 10 schematically show the ink supply system between the head 11 and the sub-tank 23. These figures illustrate the ink flow in the respective ink supply states.

Figure 7:
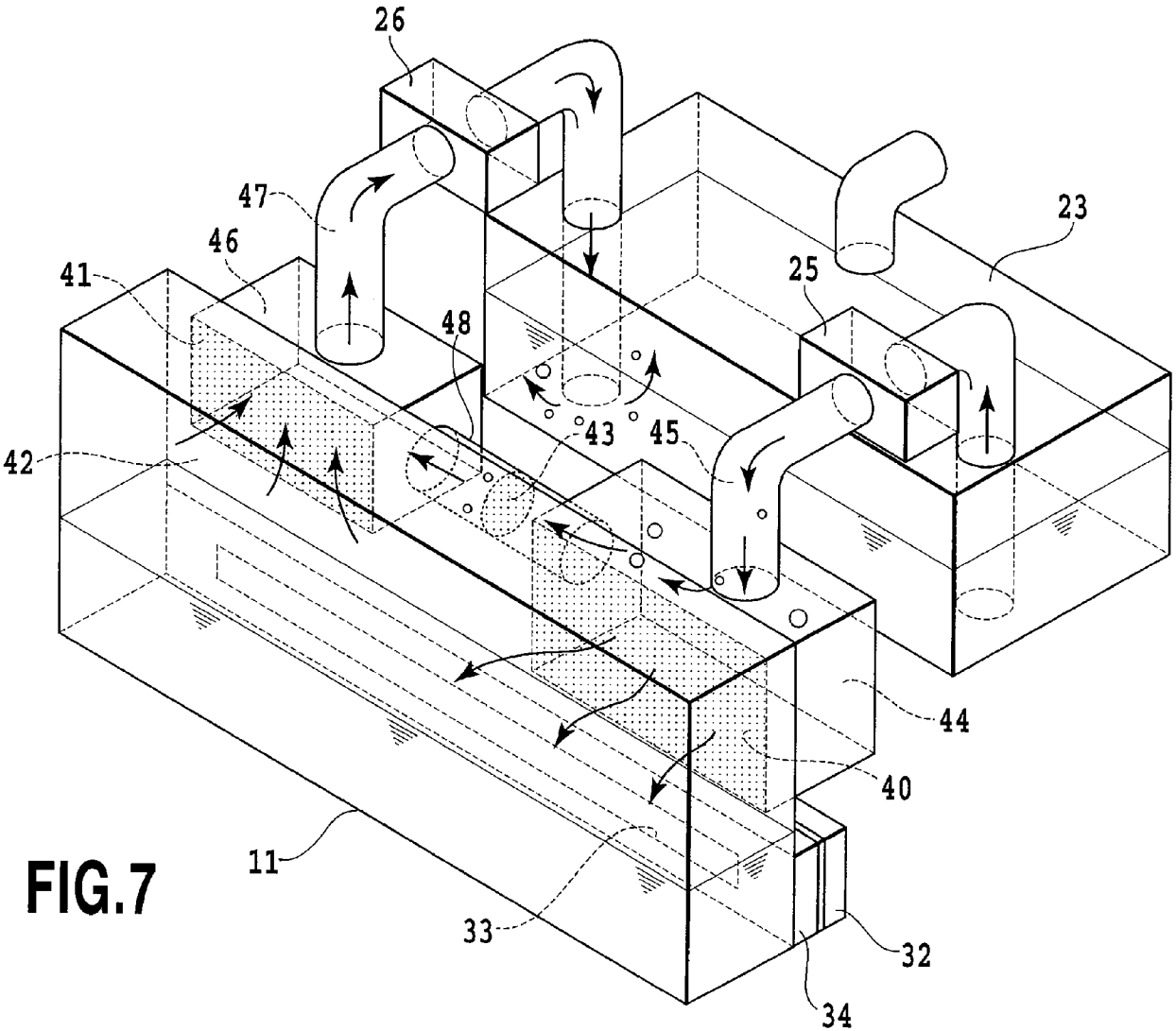
FIG. 7 is a diagram illustrating the flow of ink through a liquid supply channel in the liquid ejection head in FIG. 1 during liquid filling.

FIG. 7 shows the ink flow while the main ink supply chamber 42 is being filled with the ink.

The pressurization pump 25 is actuated to cause the ink in the sub-tank 23 to flow from the first joint opening 45 into the first ink supply chamber 44 and then through the first filter 40 into the main ink supply chamber 42. On this occasion, the gas in the main ink supply chamber 42 is discharged from the second joint opening 47 through the second filter 41 and second ink supply chamber 46. The main ink supply chamber 42 is thus filled with the ink. FIG. 7 schematically shows the ink channel. In the configuration of the head 11 in FIGS. 3 to 6, the gas in the second ink supply chamber 46 is discharged through channels L1, L2, and L3. Specifically, the gas in the second ink supply chamber 46 is discharged from the second joint opening 47 through the channel L1, formed in the ink supply case 38, the channel L2, formed by the groove in the ink supply case 38 and the ink supply case cover 39, and the channel L3, formed in the ink supply case 38.

To smoothly fill the main ink supply chamber 42 with the ink, the first filter 40, which may cause a pressure loss in the head 11, desirably has an increased area. However, the increased area of the first filter 40 reduces the flow speed of the ink per unit area of the first filter 40. This prevents the bubbles present in the first ink supply chamber 44 from passing smoothly through the first filter 40. As a result, the bubbles may be collected upstream of the first filter 40 to hinder the ink flow. Thus, the bypass channel 48 is formed to allow the first ink supply chamber 44 and second ink supply chamber 46 to communicate with each other, with the third filter 43 disposed in the channel 48, as described above. This enables the bubbles in the first ink supply chamber 44 to be discharged from the second joint opening 47 via the third filter 43 and second ink supply chamber 46. That is, the flow speed of the ink is increased in the third filter 43 to enable the bubbles to be removed from the first ink supply chamber 44. This allows the ink to be smoothly filled through the entire surface of the first filter 40.

FIG. 7 schematically shows the ink channels. In the configuration of the head 11 in FIGS. 3 to 6, a channel L4 is formed in the ink supply case 38 to allow the first joint opening 45 and first ink supply chamber 44 to communicate with each other. The groove in the ink supply case 38 and the ink supply case cover 39 form a channel L5. A channel L6 is formed in the ink supply case 38 to allow the channel L5 and the above channel L2 to communicate with each other. Consequently, the bypass channel 48 in FIG. 7 is formed of the channels L4, L5, L6, L2, and L1; the first and second ink supply chambers 44 and 46 are in communication with each other through the bypass channel 48. In short, the bypass channel 48 has only to be able to discharge the gas in the first ink supply chamber 44 from the second joint opening 47 through the third filter 43. Further, in the configuration of the head 11 in FIGS. 3 to 6, the space in the ink supply case 38 is defined by the first and second filters 40 and 41 to form the first and second ink supply chambers 44 and 46 and main ink supply chamber 42.

Figure 8:
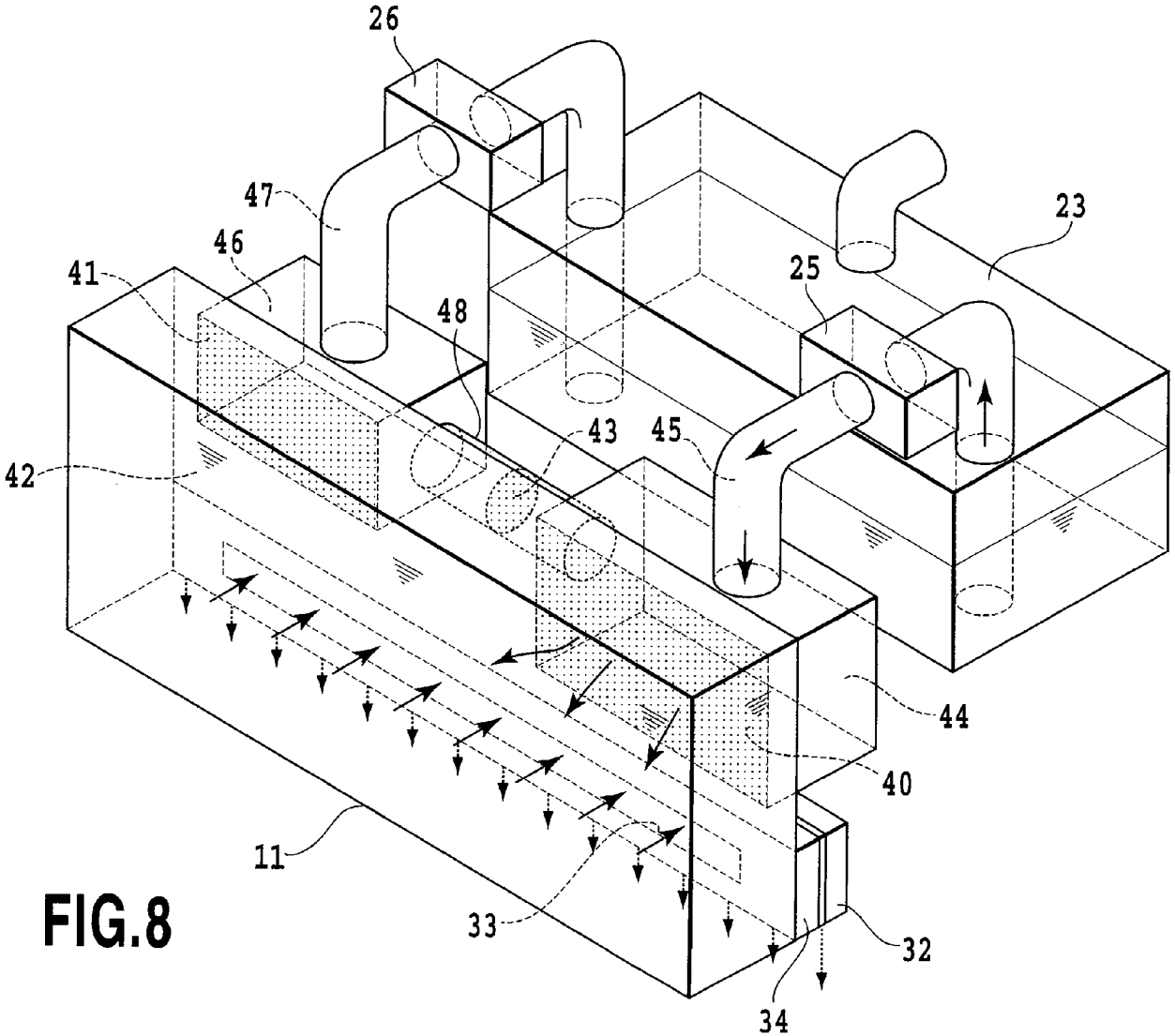
FIG. 8 is a diagram illustrating the flow of ink through the liquid supply channel in the liquid ejection head in FIG. 1 during pressurization recovery.

FIG. 8 shows the ink flow during pressurization recovery carried out to discharge bubbles, ink with an increased viscosity, foreign matter, and the like present in the nozzles of the head 11. The operation of the ink supply system during the pressurization recovery corresponds to the pressurization mode, described above.

As previously described, the ink ejection apparatus in the present example requires heat generation energy to eject the ink. Thus, a long continuous printing operation may accumulate the thermal energy in the ink to raise its temperature. A gas dissolved in the ink may then be collected in the nozzles. The ink is inappropriately ejected unless the bubbles are removed. Thus, the bubbles in the nozzles N need to be appropriately removed. The pressurization pump 25 is actuated to cause the ink in the sub-tank 23 to flow from the first joint opening 45 into the first ink supply chamber 44 and then through the first filter 40 into the main ink supply chamber 42. Since the recovery valve 26 is closed during the pressurization recovery, the ink supplied to the main ink supply chamber 42 is forcibly directed from the common liquid chamber 33 to the nozzles N. The ink is then forcibly discharged from the ejection pots of the nozzles N together with bubbles, ink with an increased viscosity, foreign matter, and the like present in the nozzles N. FIG. 8 also schematically shows the ink channel. In the configuration of the head 11 in FIGS. 3 to 6, the ink in the main ink supply chamber 42 is forcibly discharged from the ejection ports of the nozzles N through a channel L7 formed in the ink supply case 38, the communication path 34A in the roof plate 34, and the common liquid chamber 33.

Figure 9:
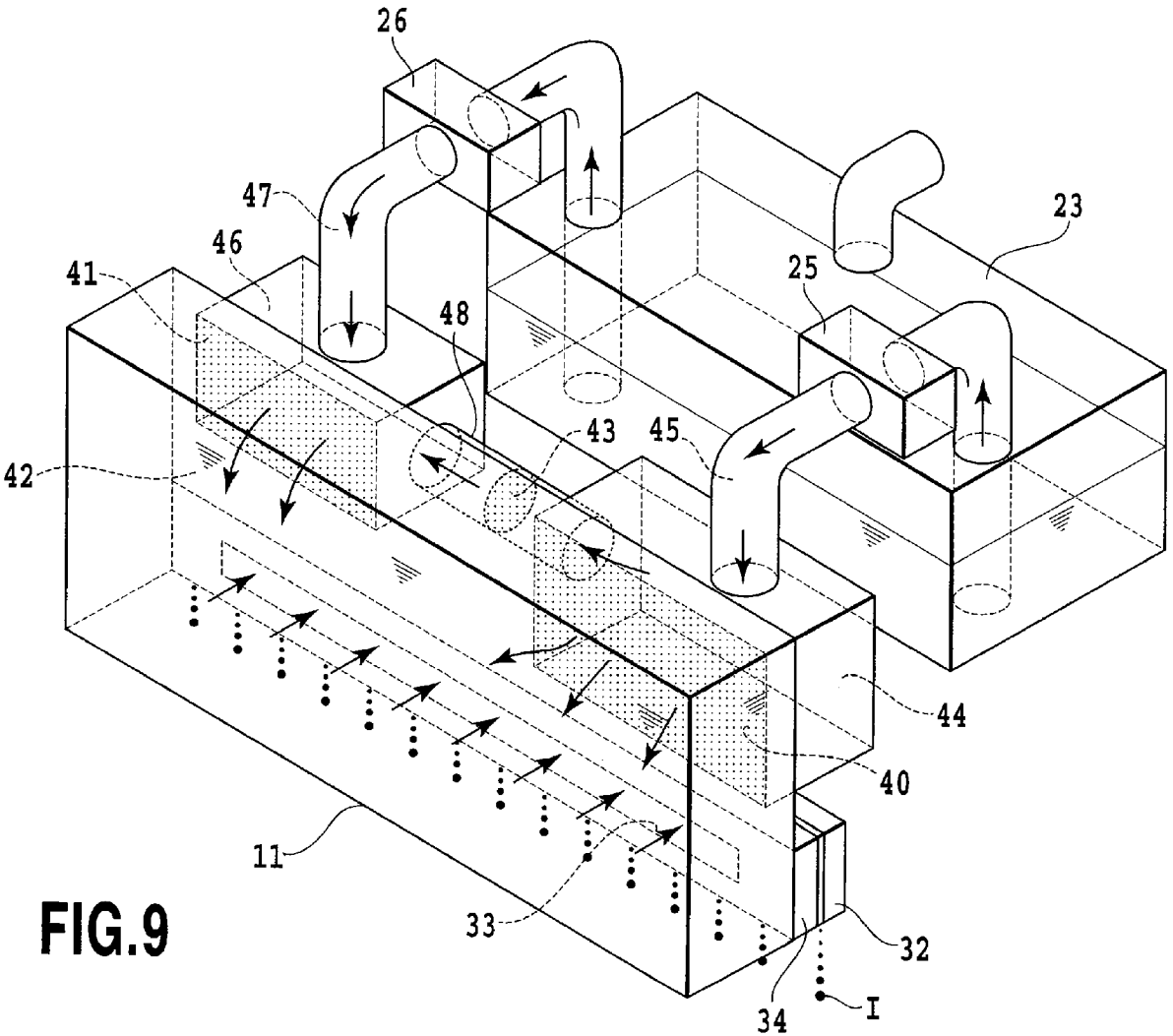
FIG. 9 is a diagram illustrating the flow of ink through the liquid supply channel in the liquid ejection head in FIG. 1 during printing.

FIG. 9 shows the ink flow during printing. The operation of the ink supply system during printing corresponds to the printing mode, described above.

Ejection of ink droplets I from the nozzles N during printing reduces the ink in the head 11 and thus the internal pressure of the head 11. Then, a capillary phenomenon in the nozzles N allows the ink in the sub-tank 23 to be supplied to the head 11 through the pressurization pump 25 and first joint opening 45. On this occasion, the recovery valve 26 is open to allow the ink to flow into the head 11 through the second joint opening 47. To maintain high-speed printing, it is necessary to smoothly supply the ink to the nozzles N and to reduce a possible pressure loss in the first filter 40. Thus, as is the case with ink filling, the bubbles in the first ink supply chamber 44 are removed so as to enable the ink to be supplied utilizing the entire surface of the first filter 40. In other words, the ink is supplied to the main ink supply chamber 42 while discharging the bubbles in the first ink supply chamber 44 via the third filter 43, provided in the bypass channel 48, extending from the first ink supply chamber 44 to the second ink supply chamber 46. This prevents the ink supply to the nozzles N from being stagnated even during high-speed printing. FIG. 9 also schematically shows the ink channel. In the configuration of the head 11 in FIGS. 3 to 6, the ink in the main ink supply chamber 42 is supplied to the interior of the nozzles N through the channel L7, formed in the ink supply case 38, the communication path 34A in the roof plate 34, and the common liquid chamber 33. The ink is then ejected through the ejection ports of the nozzles N as ink droplets I.

Figure 10:
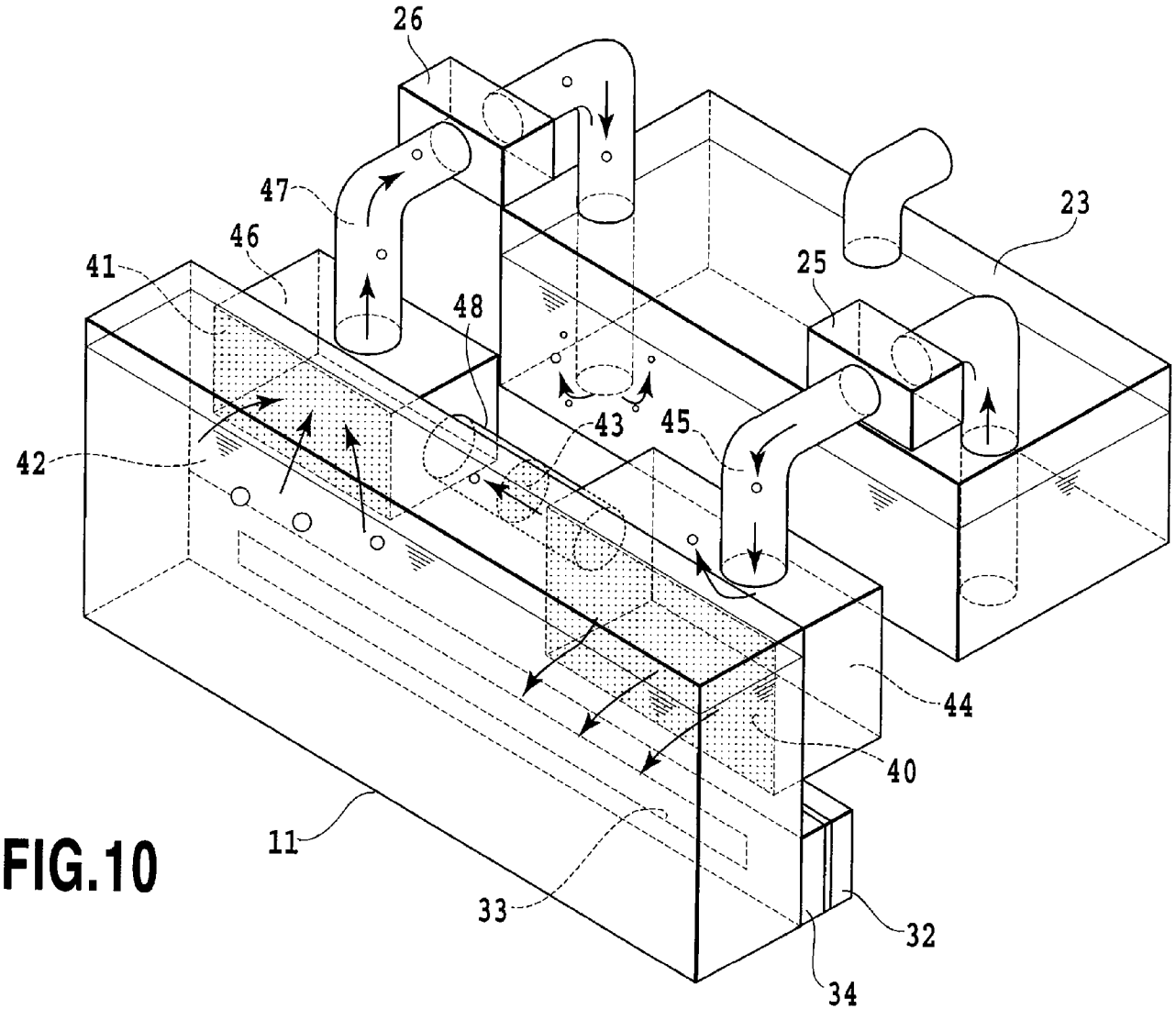
FIG. 10 is a diagram illustrating the flow of ink through the liquid supply channel in the liquid ejection head in FIG. 1 during bubble removal.

FIG. 10 shows the ink flow during circulation recovery carried out to circulate the ink between the sub-tank 23 and the head 11. The circulation recovery removes bubbles generated in the head 11 or channel during printing, allowing appropriate printing to be maintained. The operation of the ink supply system during the circulation recovery corresponds to the circulation mode, described above.

During the circulation recovery, the pressurization pump 25 is actuated to cause the ink in the sub-tank 23 to flow from the first joint opening 45 into the first ink supply chamber 44 and then through the first filter 40 into the main ink supply chamber 42. At the same time, the bubbles collected in the main ink supply chamber 42 are discharged to the second joint opening 47 through the second filter 42. Since the main ink supply chamber 42 in the head 11 in the present example is composed of a high-capacity liquid chamber, a certain amount of bubbles generated during a long continuous printing can be stored in the main ink supply chamber 42. The circulation recovery operation enables the bubbles collected in the main ink supply chamber 42 to be easily removed through the second filter 41.

Second Embodiment

Figure 11:
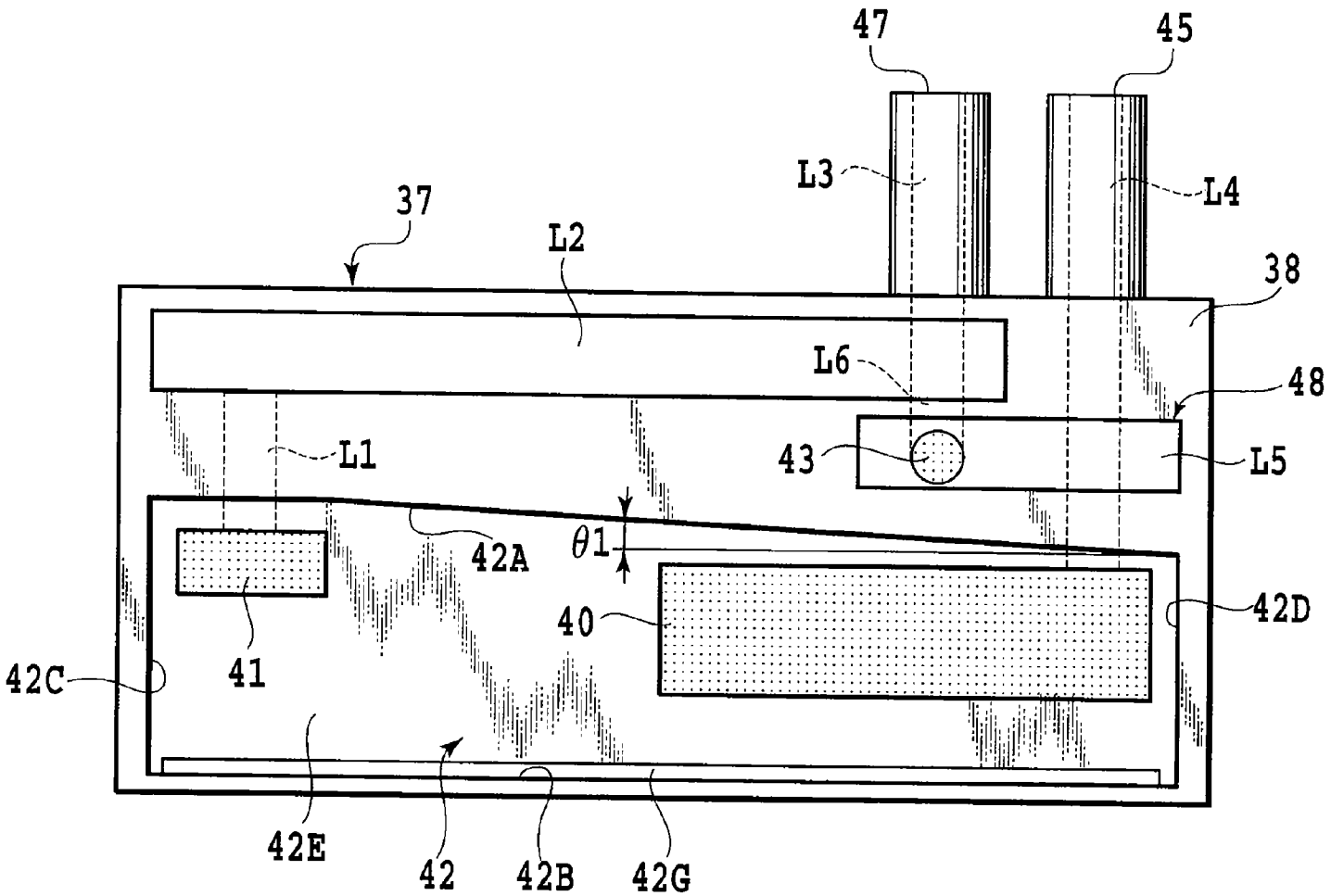
FIG. 11 is an enlarged front view of an essential part of a liquid ejection head according to a second embodiment of the present invention.
Figure 12:
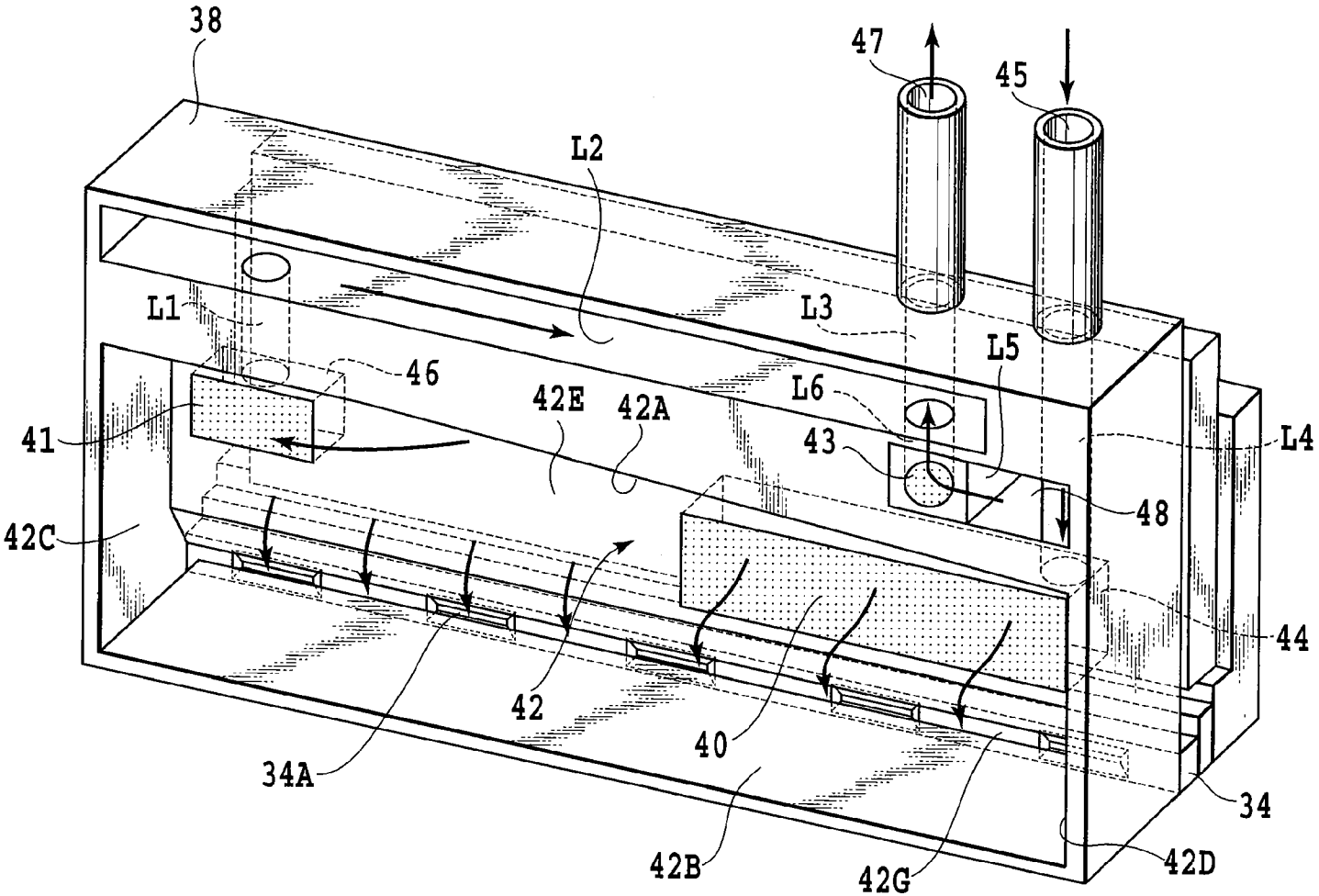
FIG. 12 is a perspective view of an essential part of the liquid ejection head in FIG. 11.

FIGS. 11 and 12 are diagrams illustrating a second embodiment of the present invention. In these figures, components similar to those in the above embodiment are denoted by the same reference numerals. Their description is thus omitted.

As is the case with the above embodiment, the main ink supply chamber (main liquid supply chamber) 42 is formed of the wall portions 42A to 42F. The bottom wall portion 42B and the supply port 42G communicated with the common liquid chamber 33 are formed parallel to the lateral direction of FIG. 11.

In the present embodiment, the top wall portion 42A is provided with a surface inclined at an angle θ1 to the horizontal direction. The inclined surface inclines upward from the first filter 40 toward the second filter 41. In other words, the wall portion 42A has the inclined surface that is not orthogonal to the direction of center of gravity. The inclined surface thus formed on the top wall portion 42A enables the bubbles in the main ink supply chamber 42 to concentrate on the second filter 41. That is, the bubbles, which float in the main ink supply chamber 42 owing to buoyancy, can be moved along the top wall portion 42A. Setting the angle θ1 to at least 4° enabled movement of the bubbles to be confirmed. Thus inclining the top wall portion 42A enables the bubbles in the head 11 to be more efficiently removed. This allows a reduction in the time required to carry out the circulation mode. The bubbles can be more effectively moved by increasing the angle θ1 above 4°. However, since the height of the head 11 increases in proportion to the angle θ1, the angle θ1 is desirably about 20° in a practical sense.

In the present example, the top wall portion 42A is orthogonal to the nozzle arrangement plane, with the inclined surface of angle θ1 formed on the wall portion 42A. However, the wall portion 42A has only to have an inclined surface portion that allows the bubbles in the main ink supply chamber 42 to be moved.

Third Embodiment

Figure 13:
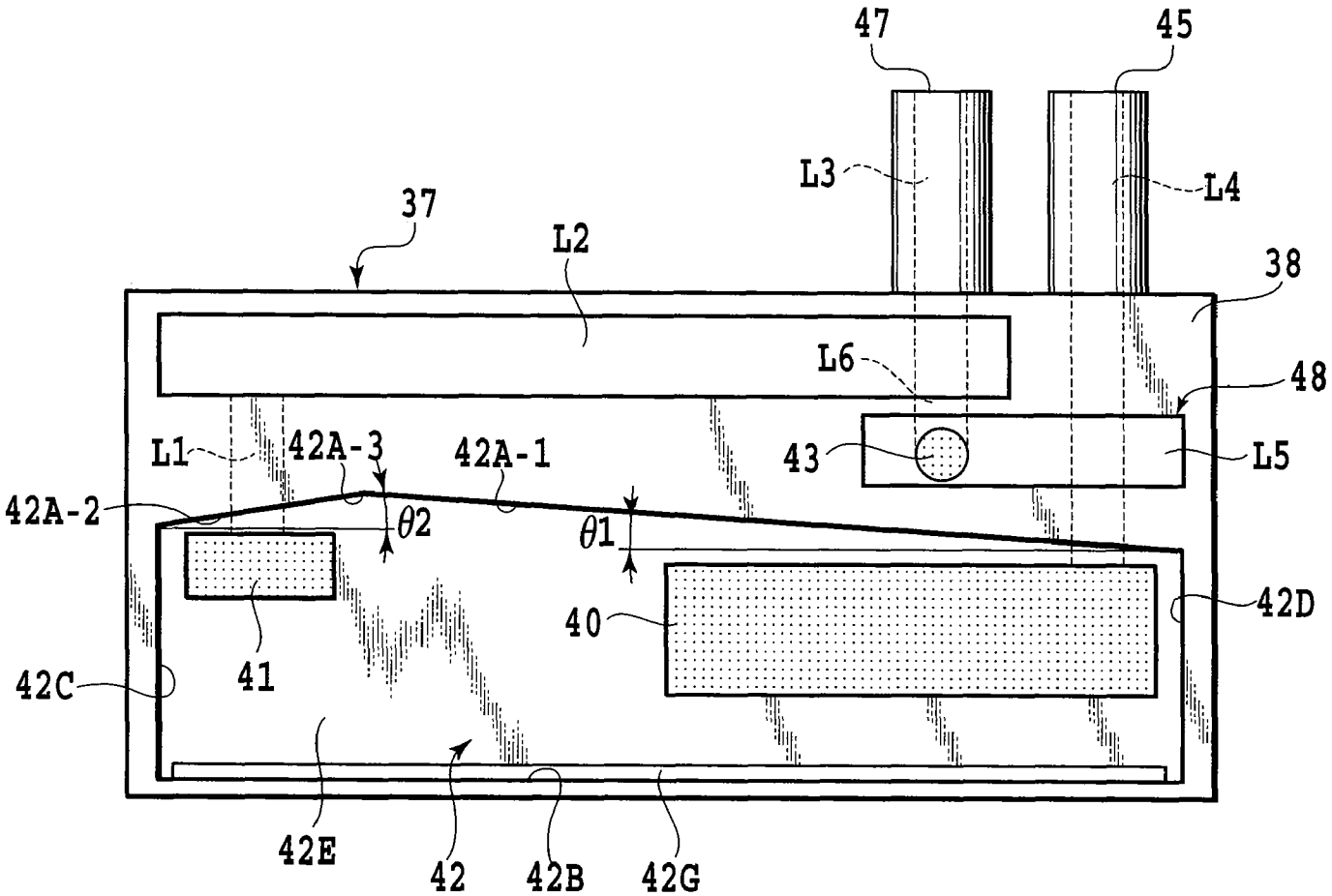
FIG. 13 is an enlarged front view of an essential part of a liquid ejection head according to a third embodiment of the present invention.

FIG. 13 is a diagram illustrating a third embodiment of the present invention. In FIG. 13, components similar to those in the above embodiment are denoted by the same reference numerals. Their description is thus omitted.

In the present embodiment, the top wall portion 42A is provided with a portion (inclined surface) 42A-1 inclined at the angle θ1 to the horizontal direction as shown in the right of FIG. 13. The portion 42A-1 inclines upward from the first filter 40 toward the second filter 41. Moreover, the top wall portion 42A is provided with a portion (inclined surface) 42A-2 inclined at the angle θ2 to the horizontal direction as shown in the left of FIG. 13. The portion 42A-2 inclines upward from the second filter 41 toward the first filter 40. These portions 42A-1 and 42A-2 form a vertex portion (vertex) 42A-3 positioned between the first filter 40 and the second filter 41.

Fine bubbles remaining in the vicinity of the second filter 41 in the main ink supply chamber 42 may hinder the ink supply from the second filter 41 during a printing operation. In the present example, the top wall portion 42A is provided with the portion 42A-2 inclining upward at the angle θ2 from the second filter 41 toward the first filter 40. This enables bubbles to be collected in the vertex portion 42A-3 of the wall portion 42A, which is located away from the second filter 41. This in turn makes it possible to maintain the ink supply performance during a printing operation so that the ink supply will not be hindered by the bubbles remaining in the vicinity of the second filter 41, while increasing the bubble removal efficiency.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A liquid supply apparatus comprising:

a first liquid supply chamber to which liquid is supplied through a supply path;

a main liquid supply chamber to which liquid is supplied from the first liquid supply chamber;

a second liquid supply chamber to which liquid is supplied from the main liquid supply chamber, liquid in the second liquid supply chamber being discharged through a discharge path;

a first filter interposed between the first liquid supply chamber and the main liquid supply chamber; and a second filter interposed between the second liquid supply chamber and the main liquid supply chamber, wherein the first filter has an area for filtering liquid larger than that of the second filter.

2. The liquid supply apparatus according to claim 1, wherein the main liquid supply chamber has a supply port for supplying liquid in the main liquid chamber to a liquid consuming portion.

3. The liquid supply apparatus according to claim 1, further comprising a bypass channel connecting the first liquid supply chamber and second liquid supply chamber.

4. The liquid supply apparatus according to claim 3, further comprising a third filter installed in the bypass channel.

5. The liquid supply apparatus according to claim 4, wherein the third filter has an area for filtering liquid smaller than that of the first filter.

6. The liquid supply apparatus according to claim 1, further comprising a guide surface formed in the main liquid supply chamber, the guide surface being positioned above the first filter and the second filter so as to guide a gas contained in liquid in a direction from the first filter to the second filter.

7. The liquid supply apparatus according to claim 6, wherein the guide surface is inclined upward in a direction from the first filter to the second filter.

* * * * *